US007878136B2

(12) United States Patent
Gruenwald

(10) Patent No.: US 7,878,136 B2
(45) Date of Patent: Feb. 1, 2011

(54) VESSEL PROPULSION

(75) Inventor: David Gruenwald, Allentown, WI (US)

(73) Assignee: Brooks Stevens Design Associates, Inc., Allentown, WI (US)

( * ) Notice: Subject to any disclaimer, the term of this patent is extended or adjusted under 35 U.S.C. 154(b) by 0 days.

(21) Appl. No.: 12/030,029

(22) Filed: Feb. 12, 2008

(65) Prior Publication Data

US 2008/0200081 A1 Aug. 21, 2008

Related U.S. Application Data

(60) Provisional application No. 60/889,596, filed on Feb. 13, 2007.

(51) Int. Cl.

| | |
|---|---|
| ***B63B 1/32*** | (2006.01) |
| *B63H 25/06* | (2006.01) |
| *B63H 5/16* | (2006.01) |
| *B63H 5/07* | (2006.01) |

(52) U.S. Cl. ..... 114/288; 114/162; 440/68; 440/79

(58) Field of Classification Search ..... 440/71, 440/72, 66, 68, 69, 79; 114/288, 61.32, 144 R, 114/162

See application file for complete search history.

(56) References Cited

U.S. PATENT DOCUMENTS

| | | | | |
|---|---|---|---|---|
| 2,244,217 | A | 6/1941 | Pries | |
| 2,272,661 | A * | 2/1942 | Finley | 114/272 |
| 2,976,836 | A | 3/1961 | Fageol | |
| 3,035,538 | A | 5/1962 | Willard | |
| 3,164,122 | A | 1/1965 | Fageol | |
| 3,859,953 | A | 1/1975 | Todt | |
| 4,637,801 | A | 1/1987 | Schultz | |
| 4,680,017 | A | 7/1987 | Eller | |
| 4,689,206 | A | 8/1987 | Owen et al. | |
| 4,694,645 | A | 9/1987 | Flyborg | |
| 4,789,302 | A | 12/1988 | Gruzling | |
| 4,826,461 | A | 5/1989 | Newman | |
| 4,907,994 | A | 3/1990 | Jones | |
| 4,957,459 | A | 9/1990 | Snyder | |
| 5,082,465 | A * | 1/1992 | Wine | 440/37 |
| 5,108,325 | A | 4/1992 | Livingston et al. | |
| 5,326,294 | A | 7/1994 | Schoell | |
| 5,890,937 | A | 4/1999 | Granger | |
| 6,045,420 | A | 4/2000 | Small et al. | |
| 6,193,573 | B1 | 2/2001 | Small | |
| 6,213,824 | B1 | 4/2001 | Small | |
| 6,260,503 | B1 | 7/2001 | Allison | |
| 6,293,218 | B1 | 9/2001 | White | |
| 6,406,341 | B1 | 6/2002 | Morejohn | |
| 6,475,045 | B2 | 11/2002 | Schultz et al. | |
| 6,544,082 | B1 | 4/2003 | Finerty | |
| 6,732,700 | B2 * | 5/2004 | Suganuma | 123/196 R |
| 6,863,013 | B2 | 3/2005 | Noyes | |
| 7,252,566 | B2 * | 8/2007 | Kamio et al. | 440/38 |
| 7,311,059 | B2 | 12/2007 | Loui et al. | |

* cited by examiner

*Primary Examiner*—Daniel V Venne
(74) *Attorney, Agent, or Firm*—McHale & Slavin, P.A.

(57) ABSTRACT

The instant invention is a shroud/keel/rudder combination for use on a engine driven marine vessel having a vented tunnel propulsion system. The combination produces acceptable acceleration, minimal loss of speed, resistance to weed entanglement and optimized steering, in both forward and reverse, especially when used with surface piercing propellers.

8 Claims, 8 Drawing Sheets

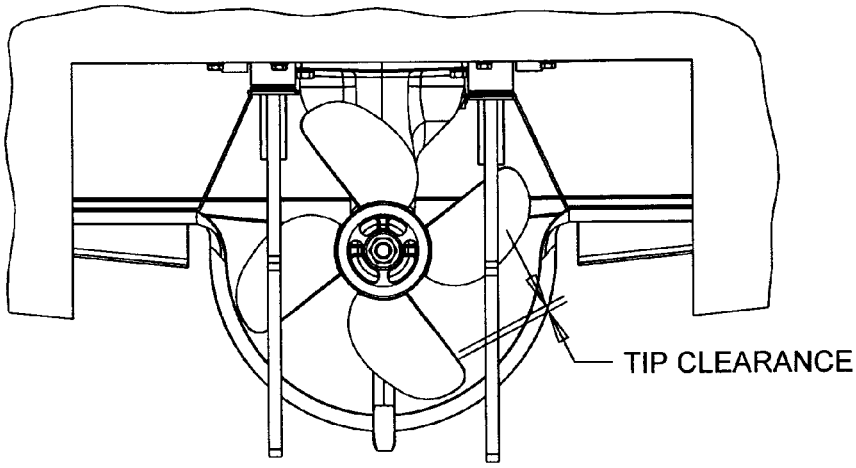
FIG. 5A
Acceleration Performance vs. Propeller Shroud Tip Clearance
| Test No. | 3-15 mph acceleration times (seconds) | Tip Clearance (% of propeller diameter) |
|---|---|---|
| | | |
| 1 | Not possible - boat will not plane. | 1 |
| 2 | Not possible - boat will not plane. | 5 |
| 3 | 45 | 10 |
| 4 | 25 | 20 |
| 5 | 18 | 30 |
| 6 | 16 | 40 |
FIG. 5B
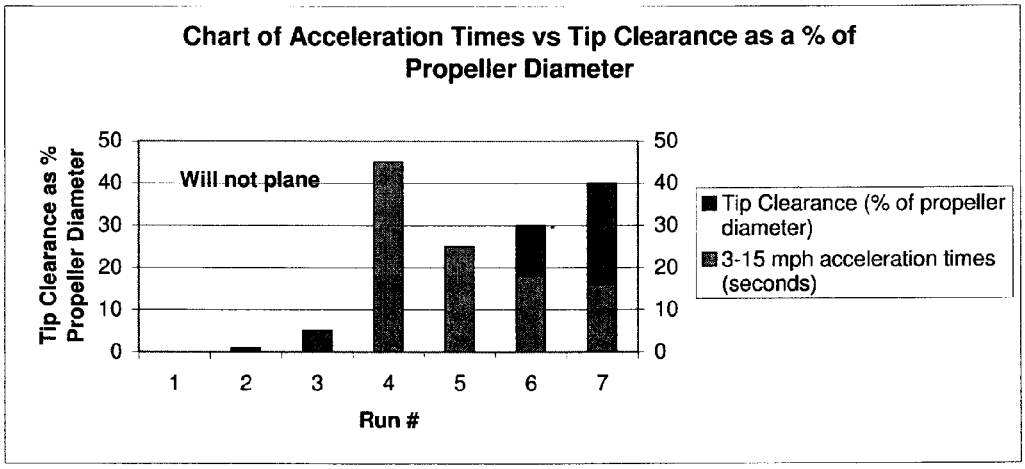
FIG. 5C

VESSEL PROPULSION

PRIORITY APPLICATION

This Application is based upon Provisional Patent Application No. 60/889,596, filed Feb. 13, 2007, and related to application Ser. No. 12/030,084 filed simultaneously with the instant application on Feb. 12, 2008, the contents of which are incorporated herein by reference.

FIELD OF THE INVENTION

This invention is directed to the field of watercraft, and in particular to surface piercing propellers in a ventilated tunnel with a protective shroud and keel and steering fins forward of the center-of-gravity of the vessel.

BACKGROUND OF THE INVENTION

It is well known in the industry that protecting the propeller of a vessel by a keel reduces the chances of damage to the propeller. It is also well known in the industry that raising the propeller up and in a tunnel reduces the chance for unplanned underwater impact. It is further known in the industry that a protective shroud provides an added level of protection for the propeller. Unfortunately it is also well known within the industry that keels and shrouds tend to have other negative side effects not the least of which are reduced acceleration and reduced steering performance. In addition, shrouds can become a source of weed entanglement.

Examples of protective shrouds can be found in U.S. Pat. Nos. 6,544,082; 6,475,045; 5,890,937; 4,957,459; 4,826,461; 4,789,302; 4,694,645; 4,680,017; 4,637,801; 3,859,953; 3,035,538; 2,244,217.

What is needed in the art is a shroud/keel combination that provides a level of protection for the propeller without hurting steering performance or acceleration and without entangling weeds.

SUMMARY OF THE INVENTION

The instant invention is a keel/shroud assembly around the propeller with greatly increased tip clearance to provide improved acceleration.

Another objective of the invention is to provide enhanced steering performance by adding fins in front of the center-of-gravity of the boat.

Another objective of the invention is to provide a means for weeds to shed from the protective shroud.

Still another objective of the instant invention is to teach the use of two steering rudders located inside the propeller slip stream.

Still another objective of the invention is to provide simplistic installation by inclusion of a conventional rudder system to the mid-section mounting base.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

FIGS. 5A, 5B and 5C depict the acceleration performance versus propeller shroud tip clearance.

DETAILED DESCRIPTION OF THE PREFERRED EMBODIMENT

Now referring to the Figures in general, depicted is a shroud and keel arrangements along with steering fins forward of the center of gravity. The use of a shroud and keel is beneficial to most any type of propulsion systems and has particular benefit for use with a drop-in vessel propulsion module which employs a tunnel created for a surface piercing propeller. The module, or drive gears, are a rigid assembly wherein the shroud protects the module from impact.

A shrouded propeller of the instant invention may include a keel and can be used with conventional propellers as well as surface piercing propellers. The shroud avoids the necessity for a breakaway gear case such as the Volvo IPS or Mercury Zeus, where breakaway design is critical to vessel safety. The IPS and Zeus extend beneath a vessel making them susceptible to impact with submerged objects. The shroud of the instant embodiment eliminates the need for a breakaway housing thereby providing a low cost, mechanically simple, propulsion system that allows a vessel to impact a submerged object without loss of the drive system.

It should be noted that the use of surface piercing propellers requires proper distancing of a shroud to the propeller tips to avoid turbulence that can prevent planning of the vessel. A surface piercing propeller is a propeller that is positioned so that when the vessel is underway the water line passes right through the propeller's hub. This definition is set forth in the article Surface-Piercing Propellers by Paul Kamen which was published in Professional Boatbuilder magazine. Conventional propellers show little acceleration differences upon placement of the shroud near the propeller tip.

Figure 1C:
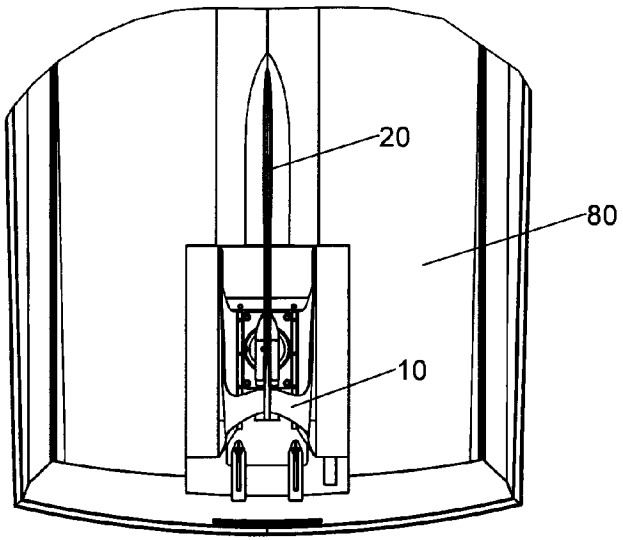
FIGS. 1A, 1B, 1C and 1D are various prospective views of a full shroud with tip clearance greater than 5% of the propeller diameter.
Figure 1D:
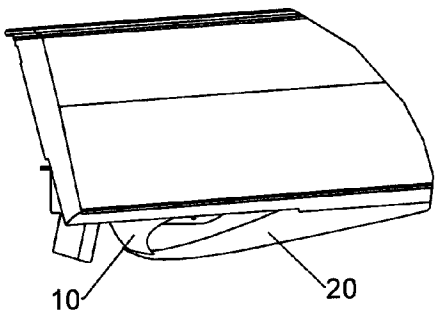
Figure 1A:
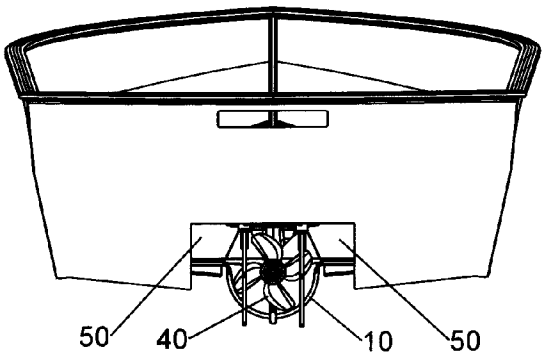
Figure 1B:
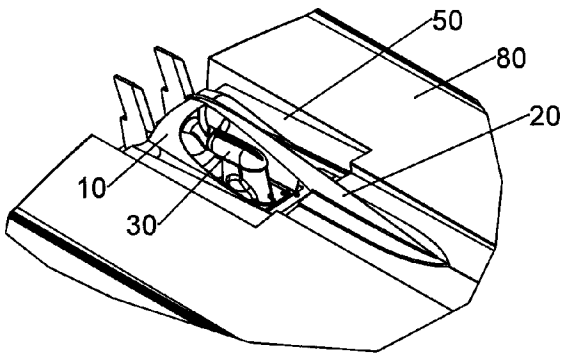
Figure 2D:
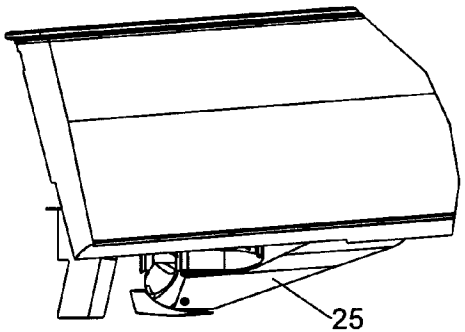
FIGS. 2A, 2B, 2C and 2D are a perspective views of a partial shroud showing the areas at each end providing for the passage of weeds.
Figure 2C:
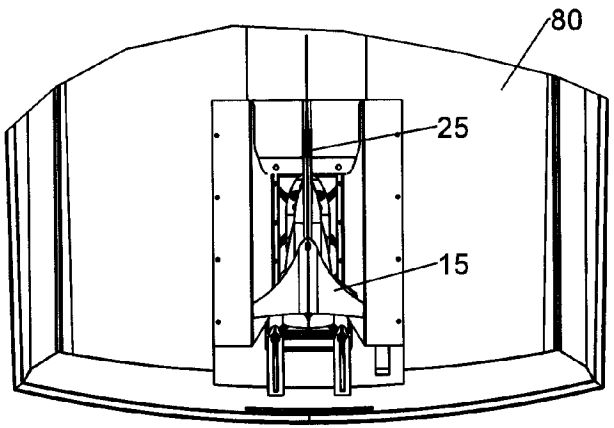
Figure 2A:
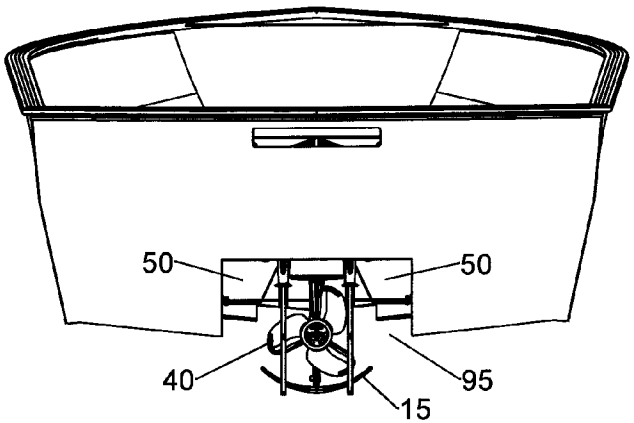
Figure 2B:
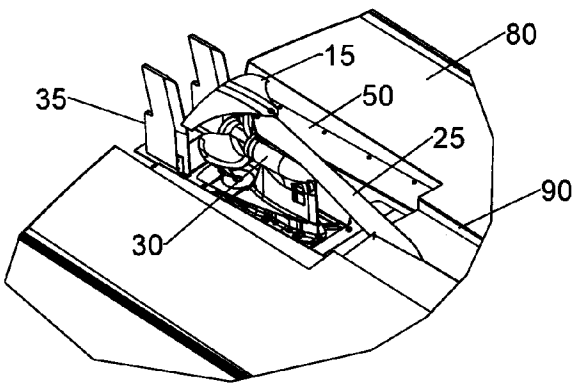
Figure 3C:
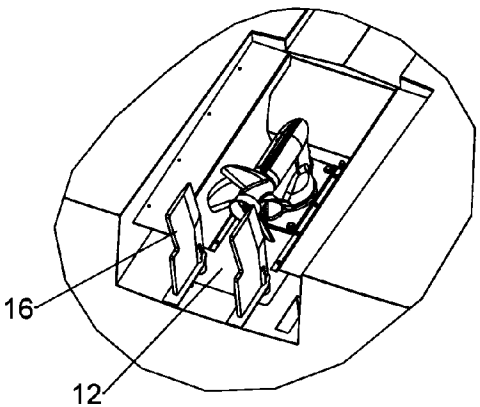
FIGS. 3A, 3B and 3C are various perspective views of dual rudders in a mounting plate.
Figure 3A:
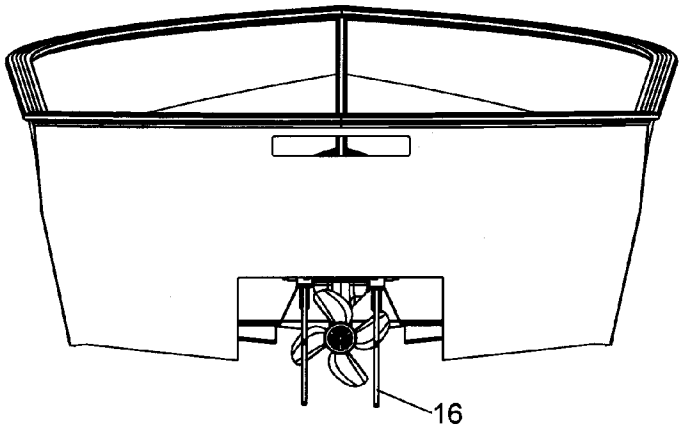
Figure 3B:
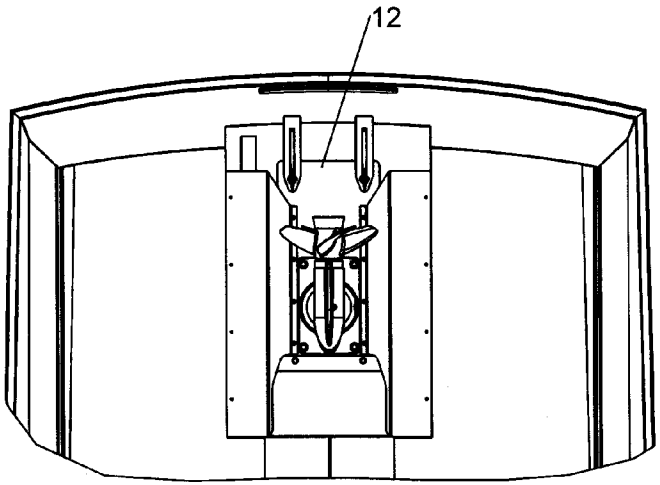
Figure 4A:
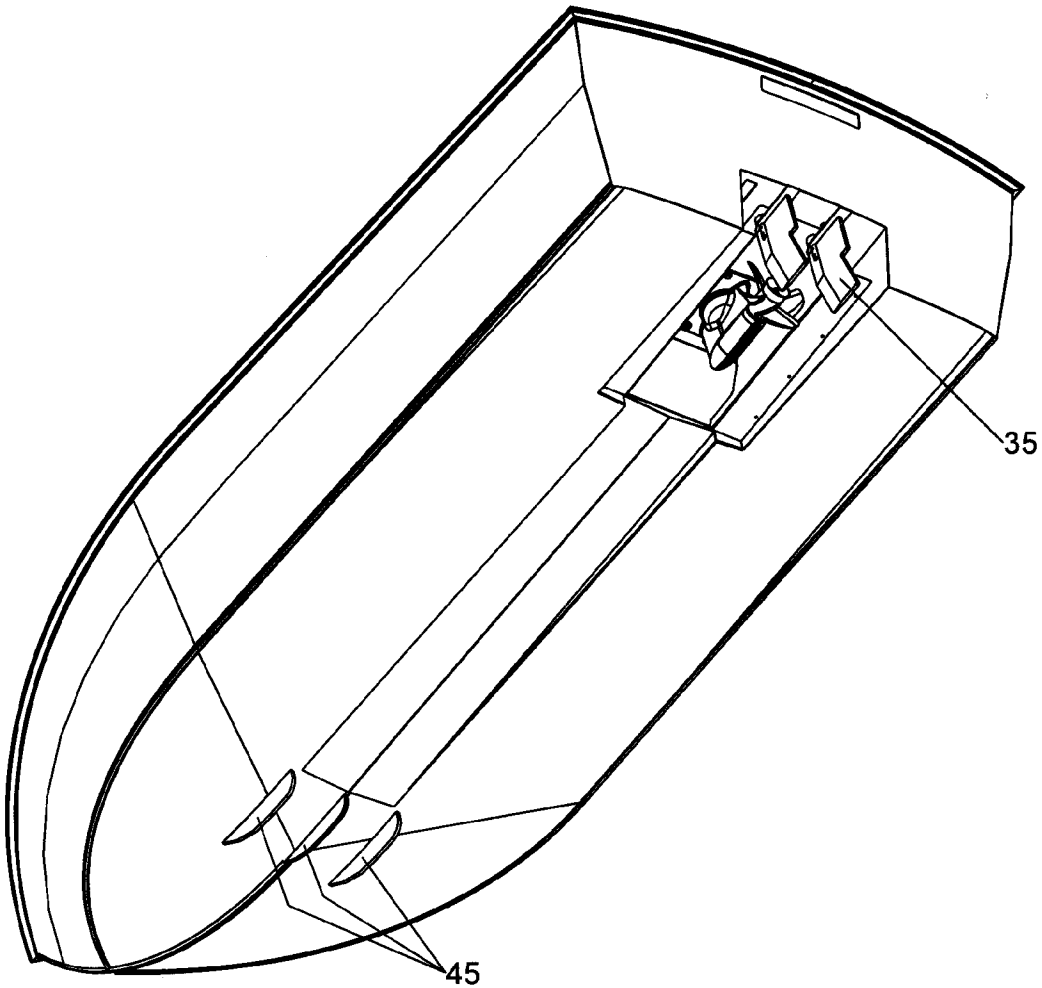
FIG. 4A, 4B, 4C and 4D are various perspective views of the steering fins forward of the center of gravity of the hull.
Figure 4B:
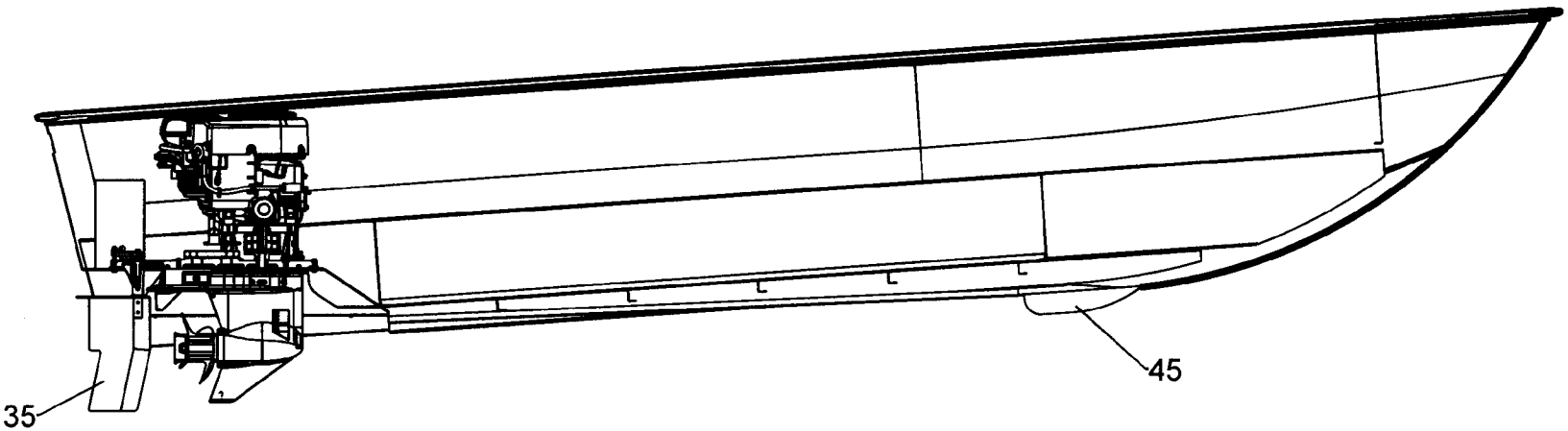
Figure 4C:
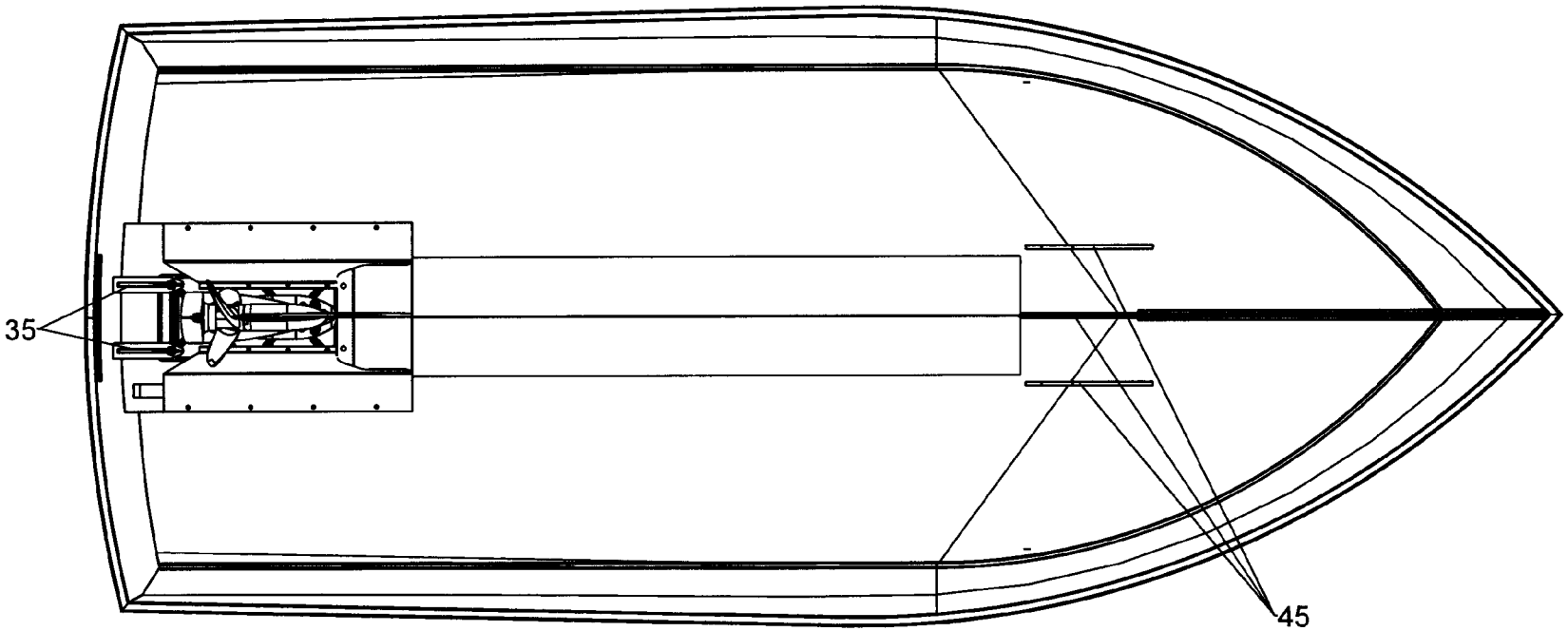
Figure 4D:
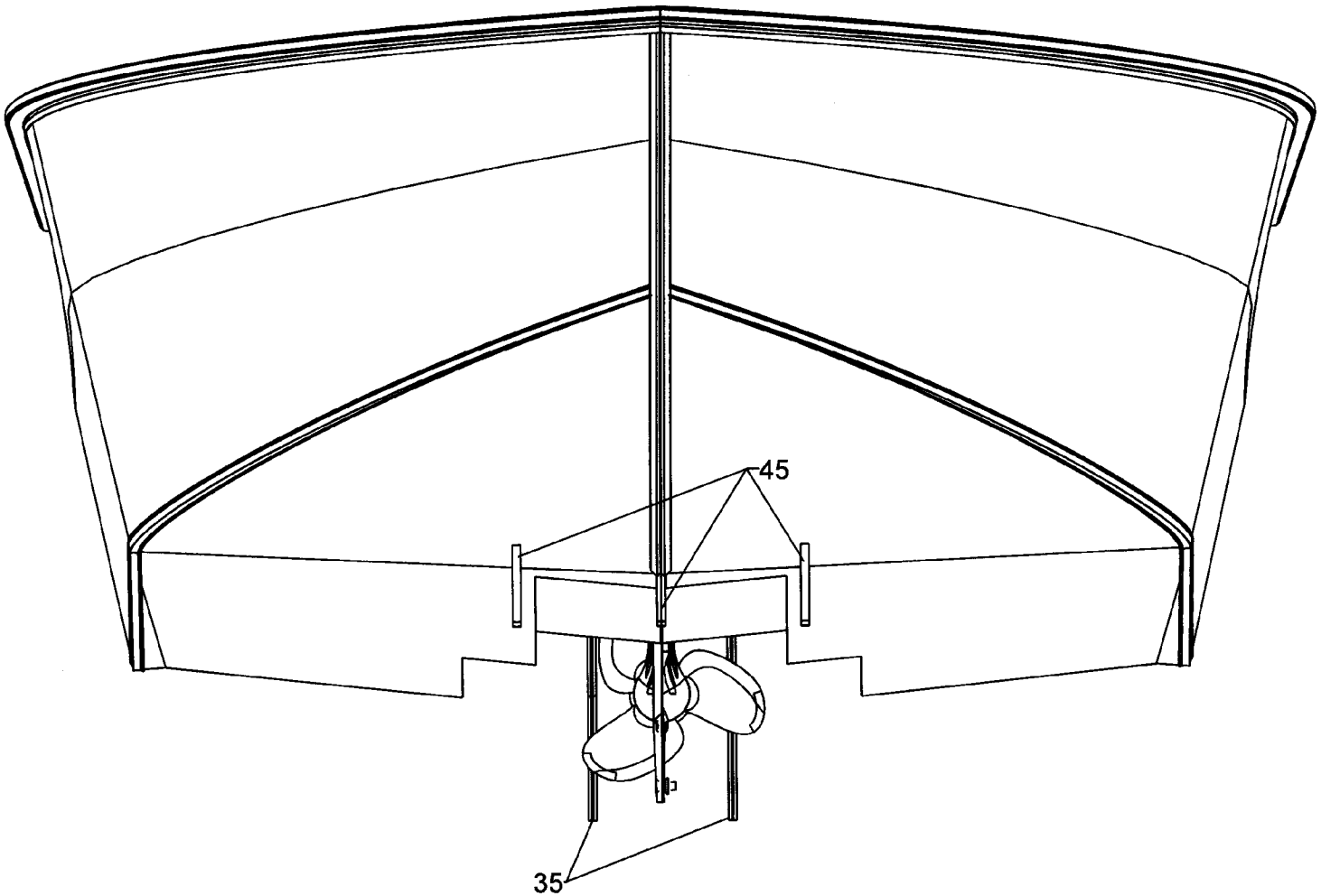

Now referring to FIGS. 1A through 1D which set forth is a tunnel embodiment for use with a drop in module, a shroud 10 is positioned around a tunnel having deep side walls as typically used with a surface piercing propeller. In this embodiment a surface piercing propeller shroud (10) is created by use of a protective keel (20) that extends beneath the gear housing (30) and propeller (40) with air drawn through a vented tunnel (50). As can be seen in FIGS. 1A, 1B and 1C the bottom of the hull has an integrated tunnel (50).

Shroud clearance is determined by a propeller tip clearance that can be determined by a measurement of the propeller diameter. Preferably tip clearance is greater than 5% of the propeller diameter to allow the vessel to achieve planning speeds. A distance between the propeller tip and the shroud greater than approximately 30% propeller diameter does not further increase performance characteristics. The protective shroud (10) extends from the bottom surface of the hull (80) to over the propeller tips to protect the propeller and the gear case from impact with submerged matter and attaches to the protective shroud (10).

FIG. 1A illustrates a rear view of the shroud (10) and the protection provided to the propeller (40) from impacts. Unlike deep side wall tunnels, the shroud (10) is opened to water at low speed eliminating propeller slippage at slower speeds. However, similar to a full tunnel, impact to the propeller and gear housing is protected.

FIGS. 2A, 2B, 2C, and 2D illustrate an embodiment which utilizes a partial shroud. The hull of the vessel 80 includes a shallow tunnel 90 that extends longitudinally along the length of the vessel and extends from a position approaching the bow of the vessel and extends to the deep walled vented tunnel 95. The hull also includes a vent tunnel 50 in a manner which is to the tunnel previously described. The surface piecing propeller 40, the gearing case 30, and the rudder assembly 35 are mounted in the vented deep wall tunnel 95. The hull also includes a protective keel 25 that is attached to the hull in a region of the shallow longitudinal tunnel 90 adjacent to the deep wall vented tunnel 95 at one end and attached to the gear housing 30 on the second and opposite end. Also attached to the second end of the protective keel 25 is a partial protective shroud 15. Shroud 15 is a wing like construction which is mounted on the protective keel 25 and the gear case skeg. The partial shroud has a leading edge facing the bow of the vessel and a trailing edge face the stern. The partial shroud extends from the protective keel 25 equally from side to side on opposite sides of the longitudinal axis of the vessel. The partial shroud 15 also has an arcuate shape from side to side. The width of the partial shroud as measured from side to side is slightly less than the diameter of the surface piercing propeller. The rudder assembly 35 includes two rudders each pivotally mounted on a vertical axis that are equally spaced from the center line of the vessel. The distance between the two vertical axes is less than the diameter of the surface piercing propeller (40).

FIGS. 5A, 5B and 5C depict the acceleration performance versus propeller shroud tip clearance. With tip clearance less than 5% of propeller diameter, planning of a boat is not possible. Greater than 5% of propeller diameter for tip clearance allows for marginal planning of the hull while beyond 30% propeller diameter tip clearance does not provide significant gains in acceleration performance.

Both shrouds and keels of ANY configuration contribute to decreased steering performance because vessels are normally steered by sliding the transom sideways (slipping). The addition of a keel resists sliding the hull sideways in a turn. In order to compensate for this reduced turning action, it has been determined that two design features can contribute to restoring steering performance. The first is the use of dual rudders in the prop wash which provide a stronger sliding force at the transom and the second being the addition of one or more steering fins, as often found on Inboard ski boats, forward of the L.C.G. (longitudinal center of gravity). It is the combination of these two features (dual rudders and steering fins) that produce sufficient steering force to compensate for the shroud and keel.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. An engine driven marine vessel comprising:

a hull having a tunnel integrated with a bottom side of said hull and having at least one engine driven surface piercing propeller having a central axis and a diameter;

a rudder assembly defined as at least two rudders mounted in said tunnel in a position aft of said surface piercing propeller, each said rudder operatively associated with a vessel steering control and juxtapositioned to an outer edge of the diameter of said surface piercing propeller, each said rudder pivotally mounted on a first and second vertical axis, said first and second axis are equidistantly spaced from a vertical axis passing through a center axis of said propeller, said two rudders are spaced from said vertical axis no greater that a diameter of said surface piercing propeller; whereby said vessel can be easily maneuvered in both a forward and reverse direction wherein each rudder controls fluid flow produced along the outer diameter of the surface piercing propeller.

2. The engine driven marine vessel of claim 1, including: a protective keel having a first end portion attached to said bottom surface of said hull and extending along a center line of said vessel at a predetermined distance beneath said surface piercing propeller to a second end portion positioned aft said surface piercing propeller;

a shroud extending from said bottom surface of the hull and having a portion covering said surface piercing propeller; whereby said protective keel and said shroud provide protection to said surface piercing propeller.

3. The engine driven marine vessel of claim 2 wherein said surface piercing propeller is defined as a plurality of blades coupled to a hub, the distance from the center of a hub of said surface piercing propeller to an outer tip of each blade forming a diameter, said diameter being the distance between outer tips of diametrically opposed blades.

4. The engine driven marine vessel of claim 2, wherein said second end portion of the protective keel is located beneath a gear housing in converting engine torque to rotate said surface piercing propeller.

5. The engine driven marine vessel of claim 3, wherein the distance between said shroud and the tips of said surface piercing propeller blades is greater than 0.05 times the diameter of a said surface piercing propeller.

6. The engine driven marine vessel of claim 2, wherein said shroud portion extending over said surface piercing propeller and a gear housing has a leading edge located longitudinally behind a leading edge of said surface piercing propeller.

7. The engine driven marine vessel of claim 1, further including a plurality of steering fins located on the hull in front of the center of gravity of the vessel.

8. The engine driven marine vessel of claim 1, wherein the surface piercing propeller has a plurality of blades, the diameter of said surface piercing propeller being the distance between tips of diametrically opposed blades, and the distance between the first and second vertical axis and the axis passing through the center axis of the surface piercing propeller, respectively, is less that one half the diameter of the surface piercing propeller.

* * * * *